US012130109B2

(12) United States Patent
Philbin et al.

(10) Patent No.: US 12,130,109 B2
(45) Date of Patent: Oct. 29, 2024

(54) AMMUNITION MAGAZINE AND HOLD-OPEN BOLT CARRIER

(71) Applicant: Perfetto Performance, Inc., Glenview, IL (US)

(72) Inventors: Kevin Philbin, Glenview, IL (US); Scott Richard Gherardini, Jr., Hoffman Estates, IL (US)

( * ) Notice: Subject to any disclaimer, the term of this patent is extended or adjusted under 35 U.S.C. 154(b) by 0 days.

(21) Appl. No.: 17/684,387

(22) Filed: Mar. 1, 2022

(65) Prior Publication Data

US 2022/0252365 A1 Aug. 11, 2022

Related U.S. Application Data

(63) Continuation of application No. PCT/US2021/014953, filed on Jan. 25, 2021.

(60) Provisional application No. 62/965,048, filed on Jan. 23, 2020.

(51) Int. Cl.

| | |
|---|---|
| ***F41A 9/66*** | (2006.01) |
| ***F41A 3/12*** | (2006.01) |
| ***F41A 3/54*** | (2006.01) |
| ***F41A 9/67*** | (2006.01) |
| ***F41A 9/70*** | (2006.01) |
| ***F41A 17/36*** | (2006.01) |

(52) U.S. Cl.

CPC ..... *F41A 9/66* (2013.01); *F41A 3/12* (2013.01); *F41A 3/54* (2013.01); *F41A 9/67* (2013.01); *F41A 9/70* (2013.01); *F41A 17/36* (2013.01)

(58) Field of Classification Search

CPC ... F41A 9/65–9/71; F41A 17/36; F41A 17/42; F41A 3/54

See application file for complete search history.

(56) References Cited

U.S. PATENT DOCUMENTS

| | | | | |
|---|---|---|---|---|
| 4,356,653 | A * | 11/1982 | Swieskowski | F41A 9/70 42/50 |
| 8,898,946 | B1 * | 12/2014 | Johnson | F41A 17/36 42/49.02 |
| 9,255,749 | B2 * | 2/2016 | Faifer | F41A 9/65 |
| 9,470,464 | B2 | 10/2016 | Kielsmeier et al. | |
| 2010/0162604 | A1 * | 7/2010 | Dubois | F41A 21/482 42/2 |
| 2014/0215878 | A1 | 8/2014 | Fitzpatrick et al. | |
| 2014/0373416 | A1 * | 12/2014 | Barnhart | F41A 9/67 42/50 |
| 2015/0075049 | A1 * | 3/2015 | Klarborg | F41A 9/70 42/49.01 |
| 2015/0121736 | A1 * | 5/2015 | Faifer | F16F 1/021 42/49.01 |
| 2016/0003568 | A1 | 1/2016 | Spykerman et al. | |
| 2016/0025436 | A1 | 1/2016 | Higley | |

(Continued)

FOREIGN PATENT DOCUMENTS

| | | | | |
|---|---|---|---|---|
| AU | 2015202498 | A1 * | 10/2015 | F41A 9/70 |

OTHER PUBLICATIONS

PCT/US2021/014953, International Search Report & Written Opinion (Dec. 13, 2021), 21 pages.

*Primary Examiner* — Gabriel J. Klein

(74) *Attorney, Agent, or Firm* — CHERSKOV FLAYNIK & GURDA

(57) ABSTRACT

The present disclosure provides ammunition magazines and hold-open bolt carriers for using low-cost (e.g., 22LR) ammunition in a standard AR-15 or M16 upper receiver.

13 Claims, 8 Drawing Sheets

(56) References Cited

U.S. PATENT DOCUMENTS

| | | | | |
|---|---|---|---|---|
| 2017/0023322 | A1 | 1/2017 | Nakayama et al. | |
| 2017/0138685 | A1* | 5/2017 | Beasley | F41A 9/71 |
| 2017/0184361 | A1* | 6/2017 | Cheng | F41A 17/36 |
| 2018/0209753 | A1 | 7/2018 | Faifer | |
| 2018/0292154 | A1 | 10/2018 | Maga | |
| 2018/0364003 | A1* | 12/2018 | Henderson | F41A 9/65 |
| 2019/0086170 | A1 | 3/2019 | Nakayama et al. | |
| 2019/0098978 | A1 | 3/2019 | Maugham | |
| 2019/0195591 | A1* | 6/2019 | Keng | F41C 27/22 |
| 2019/0331444 | A1 | 10/2019 | Underwood et al. | |
| 2020/0284544 | A1* | 9/2020 | Keng | F41A 23/04 |
| 2022/0065567 | A1* | 3/2022 | Philbin | F41A 9/70 |
| 2022/0364809 | A1* | 11/2022 | Overstreet | F41A 9/70 |
| 2022/0390203 | A1* | 12/2022 | Keng | B25B 15/02 |

* cited by examiner

AMMUNITION MAGAZINE AND HOLD-OPEN BOLT CARRIER

PRIORITY CLAIM

This application is filed under 35 U.S.C. § 111(a) and claims priority under 35 U.S.C. § 365(c) to PCT Patent Application Serial No. PCT/US21/14953, filed in the United States Receiving Office on Jan. 25, 2021, which claims priority to U.S. Provisional Patent Application Ser. No. 62/965,048, filed on Jan. 23, 2020, the entire contents of each of which are incorporated herein by reference and relied upon.

BACKGROUND

The AR-15 and M16 firearm platforms are flexible, enabling reliable firing of many calibers of ammunition. However, ammunition native to the AR-15 and M16 platforms (e.g., 0.223 and 5.56 rounds) are relatively expensive, making regular training exercises with the AR-15 and M16 platforms costly.

A need persists for convenient means of utilizing economical ammunition (e.g., 22LR rounds) with an AR-15 or M16 upper receiver to simulate more costly 0.223 or 5.56 ammunition.

Summary

The present disclosure provides ammunition magazines and hold-open bolt carriers for using low-cost (e.g., 22LR) ammunition in a standard AR-15 or M16 upper receiver.

In some embodiments, the present disclosure provides an ammunition magazine configured to bottom-feed a plurality of ammunition rounds into an upper receiver of a firearm, the ammunition magazine comprising: a magazine housing including an ammunition reservoir, a proximal guide channel disposed proximal to the ammunition reservoir, and lips disposed on a top surface of the magazine housing, the lips configured to align the ammunition reservoir with a feed ramp of the upper receiver; a spring within the magazine housing; a floor plate retainer disposed at a bottom end of the spring; a floor plate disposed at a bottom end of the magazine housing and reversibly mated with the floor plate retainer; and a magazine follower disposed at a top end of the spring, the magazine follower including a follower protrusion disposed on a superior portion of the magazine follower, and a bolt catch piston disposed at a proximal end of the magazine follower and configured to slide along the proximal guide channel of the magazine housing.

In other embodiments, the present disclosure provides a bolt carrier for aligning a rimfire primer of an ammunition round with a centerfire firing pin of a firearm, the bolt carrier comprising: a bolt carrier body having a generally cylindrical cross-sectional shape and including a side-disposed extractor disposed on one side of the bolt carrier body, a centerfire bore disposed through the bolt carrier body and configured to enable a centerfire firing pin to slide therethrough, a forward assist adaptor disposed at a proximal end of the bolt carrier body and including a plurality of side-disposed ridges configured to temporarily engage with a forward assist piston of an upper receiver, a hold-open fin disposed on an inferior portion of the bolt carrier body and configured to engage with a bolt catch of a lower receiver of a firearm after a final ammunition round from the ammunition magazine is struck by the centerfire firing pin, and a rimfire alignment shoulder disposed on a distal end of the bolt carrier body and configured to align the centerfire bore with a rim of an ammunition round from the ammunition magazine; and a sleeve disposed on a superior portion of the bolt carrier body and configured to enable the bolt carrier to slide along a rod.

In other embodiments, the present disclosure provides a kit comprising an ammunition magazine as disclosed herein and a bolt carrier as disclosed herein.

DETAILED DESCRIPTION

Figure 1A:
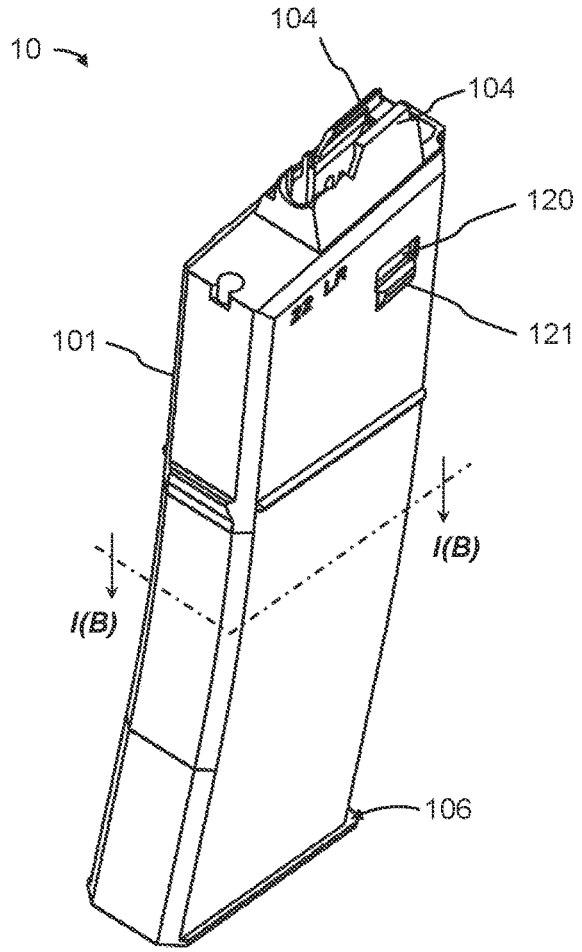
FIG. 1A shows a perspective view of an ammunition magazine consistent with the present disclosure.
Figure 1B:
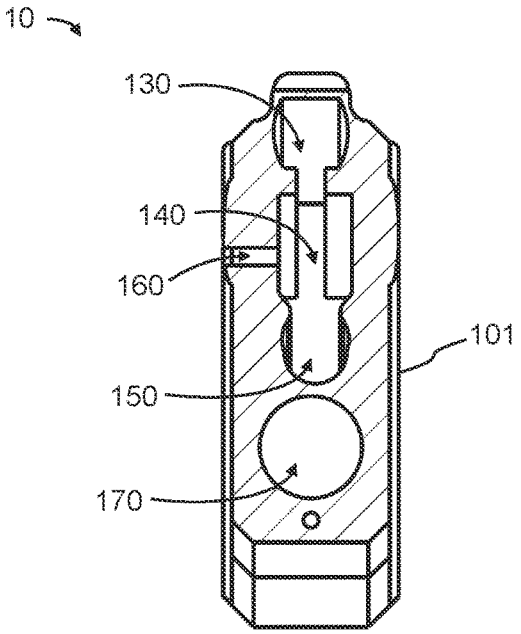
FIG. 1B shows a cross-sectional view of the ammunition magazine of FIG. 1A.
Figure 2:
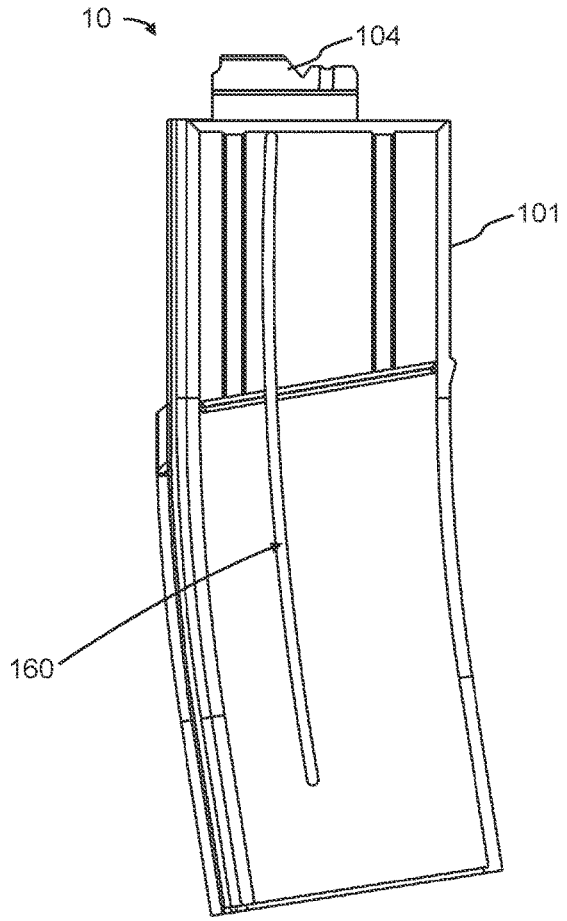
FIG. 2 shows a side plan view of the ammunition magazine of FIG. 1A.
Figure 3:
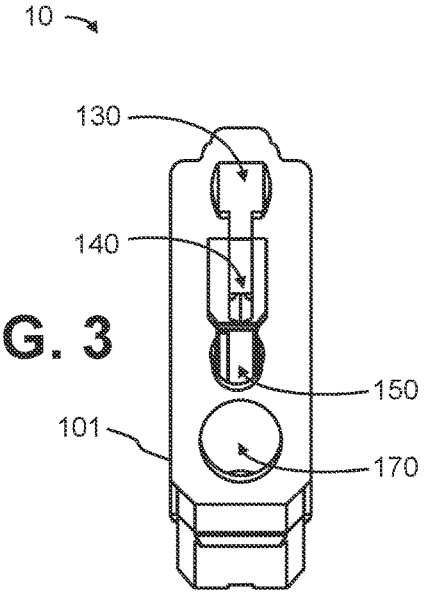
FIG. 3 shows a top perspective view of the ammunition magazine of FIG. 1A.

Referring generally to FIGS. 1A-12, the present disclosure provides ammunition magazines and hold-open bolt carriers for using low-cost (e.g., 22LR) ammunition in a standard AR-15 or M16 upper receiver.

Referring to FIGS. 1A-3, ammunition magazines 10 consistent with the present disclosure are configured to removably mate with a lower receiver of a firearm, and to bottom-feed ammunition rounds into the upper receiver. The ammunition magazine 10 comprises a housing 101 that defines (e.g., includes) an ammunition reservoir 140, a distal guide channel 150, a recess 120, a boss 121, and lips 104; a follower 15; and a spring 17 configured to force the follower 15 towards a superior end of the ammunition magazine 10 wherein the spring is disposed within the magazine housing.

The ammunition reservoir 140 is configured to retain a plurality of ammunition rounds. In some embodiments, the ammunition reservoir 140 is configured to retain the ammunition rounds in a single stack arrangement. In other embodiments, the ammunition reservoir 140 is configured to retain the ammunition rounds in a double stack arrangement. In some embodiments, the ammunition reservoir 140 is configured to hold at least about 15 ammunition rounds, for example 15 ammunition rounds, 16 ammunition rounds, 17 ammunition rounds, 18 ammunition rounds, 19 ammunition rounds, 20 ammunition rounds, 21 ammunition rounds, 22 ammunition rounds, 23 ammunition rounds, 24 ammunition rounds, 25 ammunition rounds, 26 ammunition rounds, 27 ammunition rounds, 28 ammunition rounds, 29 ammunition rounds, 30 ammunition rounds, or more than 30 ammunition rounds.

The distal guide channel 150 is disposed parallel to the ammunition reservoir 140 and is configured to receive a distal guide piston 153*a* of the follower 15.

The recess 120 is disposed on the outside face of the ammunition magazine 10. The boss 121 is disposed below the recess 120 on the outside face of the ammunition magazine 10. The recess 120 and boss 121 are configured to mate with a magazine catch of the firearm.

The lips 104 are disposed on the superior end of the ammunition magazine 10 and are configured to guide the ammunition rounds from the ammunition reservoir 140 to the upper receiver. In some embodiments, such as those consistent with FIGS. 1A and 2, the lips 104 include a contoured superior edge profile that facilitates convenient addition of ammunition rounds to the ammunition reservoir 140.

The magazine housing 101 further defines (e.g., includes) a floor plate receiver 106 disposed at the inferior end of the ammunition magazine 10 and configured to receive a floor plate retainer 107, wherein the floor plate retainer is disposed at a bottom end of the spring 17.

In some embodiments, the magazine housing 101 further defines (e.g., includes) a proximal guide channel 130 that is disposed parallel to the ammunition reservoir 140 and is configured to receive a bolt catch piston 153*b* of the follower 15.

In some embodiments, the magazine housing 101 further defines (e.g., includes) a channel 160 disposed through a side face or an end face of the magazine housing 101. The channel 160, when present, enables a loading tab (not shown) of the magazine follower 15 to protrude therethrough such that a user can apply force against the spring to ease loading of ammunition rounds into the ammunition reservoir 140.

In some embodiments, the magazine housing 101 further includes a storage compartment 170 disposed distal to the distal guide channel 150. The storage compartment 170 may be used to store tools or accessories, for example, such as a tool including a tip configured to pass through the channel 160 in the magazine housing 101 and further configured to mate with the recess 154 of the follower 15 described more fully below.

Referring now to FIGS. 4A-4D, a follower 15 is disposed within the magazine housing 101 and is configured to separate the ammunition rounds from the spring. In general, the follower 15 comprises a follower protrusion 151 disposed on the superior portion of the follower 15, a spring tang 152 disposed on the inferior portion of the follower 15, and a body portion 153 including a bolt catch piston 153*b* disposed on the proximal end of the body portion 153.

The follower protrusion 151 is generally wedge shaped, and includes an apex 151*a* at the distal end of the follower protrusion 151. The wedge shape of the follower protrusion 151 is configured to assist feeding ammunition rounds to the feed ramp of the upper receiver of the firearm (not shown). In some embodiments, the wedge shape is defined by an angle $\alpha$ measured between the top surface 151*b* of the follower protrusion 151 and the top surface 153*c* of the body portion 153. In such embodiments, the angle $\alpha$ may be about 8° to about 15°, for example about 8°, about 8.1°, about 8.2°, about 8.3°, about 8.4°, about 8.5°, about 8.6°, about 8.7°, about 8.8°, about 8.9°, about 9°, about 9.1°, about 9.2°, about 9.3°, about 9.4°, about 9.5°, about 9.6°, about 9.7°, about 9.8°, about 9.9°, about 10°, about 10.1°, about 10.2°, about 10.3°, about 10.4°, about 10.5°, about 10.6°, about 10.7°, about 10.8°, about 10.9°, about 11°, about 11.1°, about 11.2°, about 11.3°, about 11.4°, about 11.5°, about 11.6°, about 11.7°, about 11.8°, about 11.9°, about 12°, about 12.1°, about 12.2°, about 12.3°, about 12.4°, about 12.5°, about 12.6°, about 12.7°, about 12.8°, about 12.9°, about 13°, about 13.1°, about 13.2°, about 13.3°, about 13.4°, about 13.5°, about 13.6°, about 13.7°, about 13.8°, about 13.9°, about 14°, about 14.1°, about 14.2°, about 14.3°, about 14.4°, about 14.5°, about 14.6°, about 14.7°, about 14.8°, about 14.9°, or about 15°. In some embodiments, the angle $\alpha$ is about 10° to about 11°, for example about 10°, about 10.1°, about 10.2°, about 10.3°, about 10.4°, about 10.5°, about 10.6°, about 10.7°, about 10.8°, about 10.9°, or about 11°. In some embodiments, the angle $\alpha$ is about 10.2°.

Figure 4A:
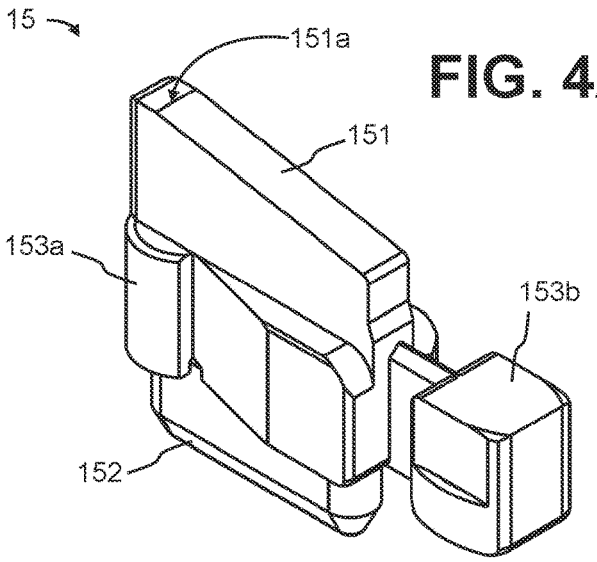
FIG. 4A shows a perspective view of a magazine follower consistent with the present disclosure.
Figure 4B:
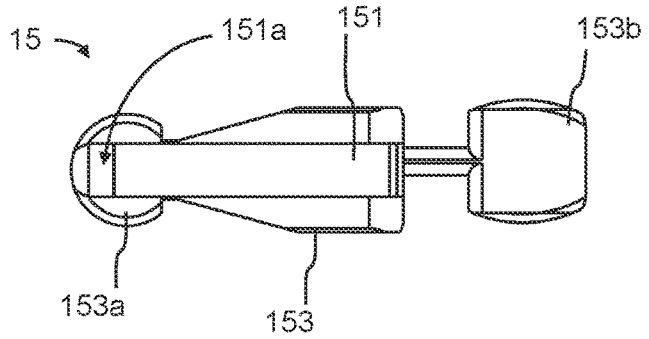
FIG. 4B shows a top plan view of the magazine follower of FIG. 4A.
Figure 4C:
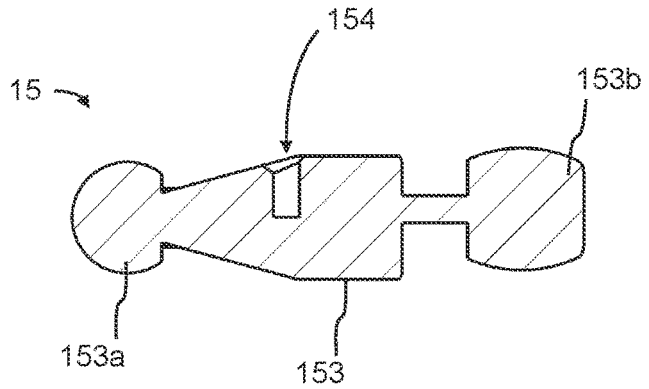
FIG. 4C shows a cross-sectional view of the magazine follower of FIG. 4A.
Figure 4D:
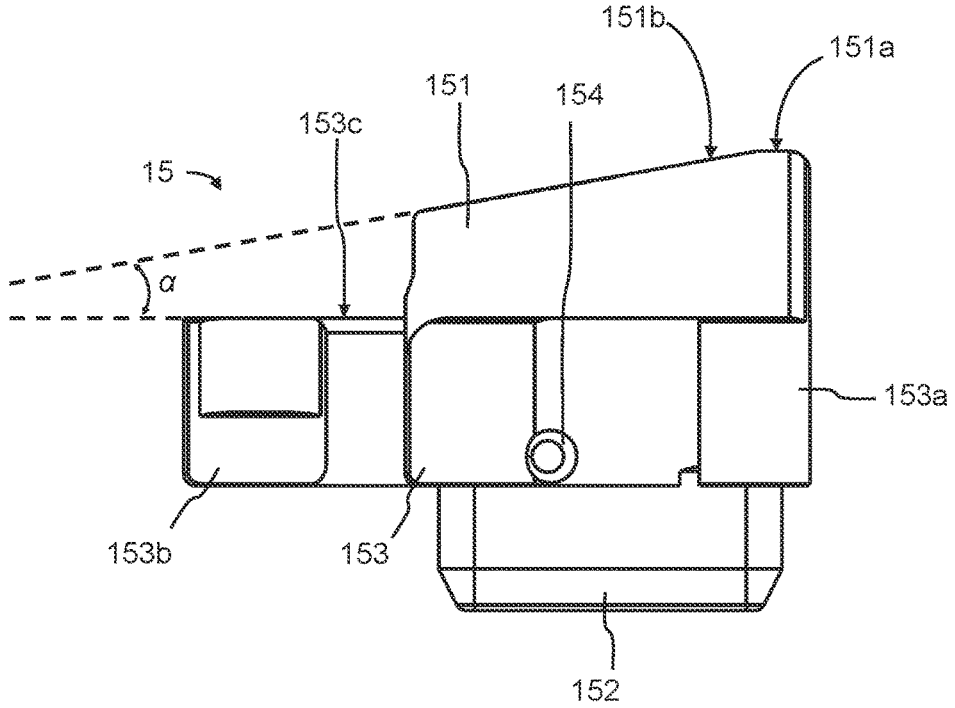
FIG. 4D shows a side plan view of the magazine follower of FIG. 4A.
Figure 4E:
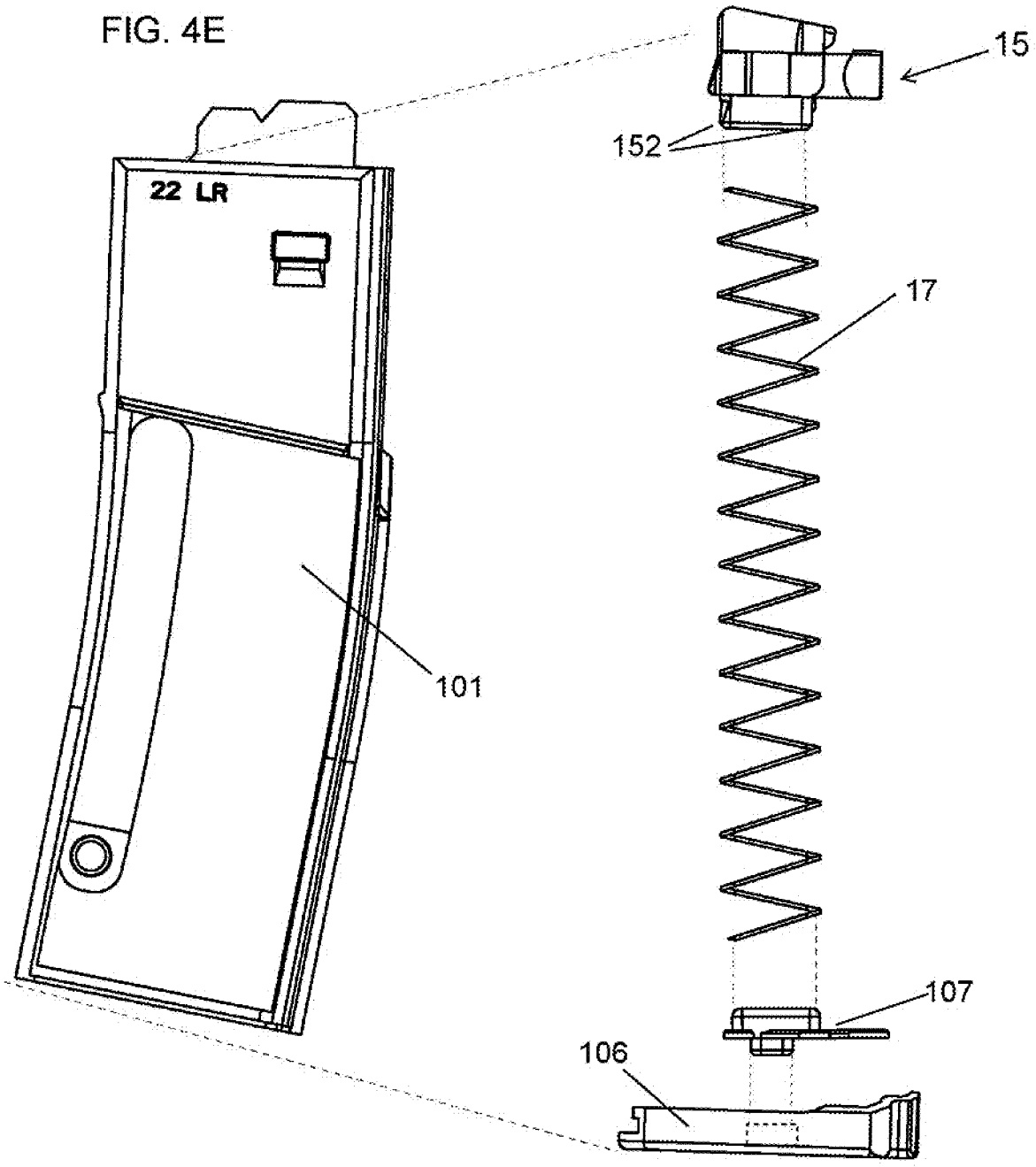
FIG. 4E shows spring detail of the ammunition magazine.
Figure 5:
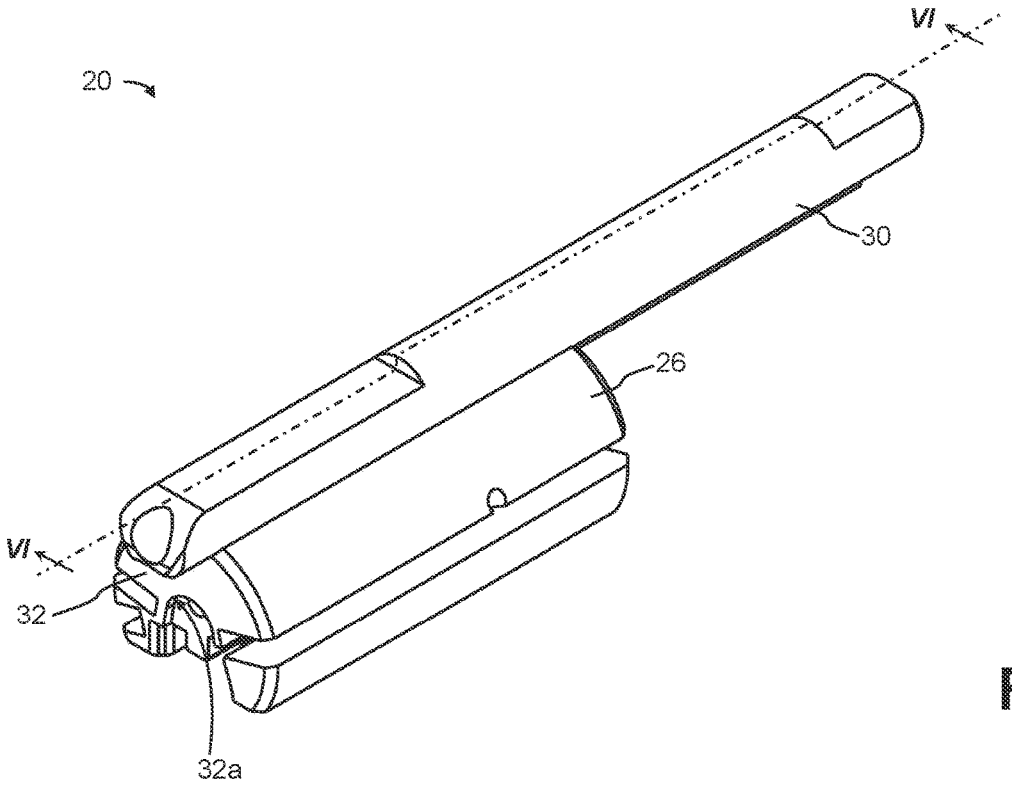
FIG. 5 shows a perspective view of a bolt carrier consistent with the present disclosure.
Figure 6:
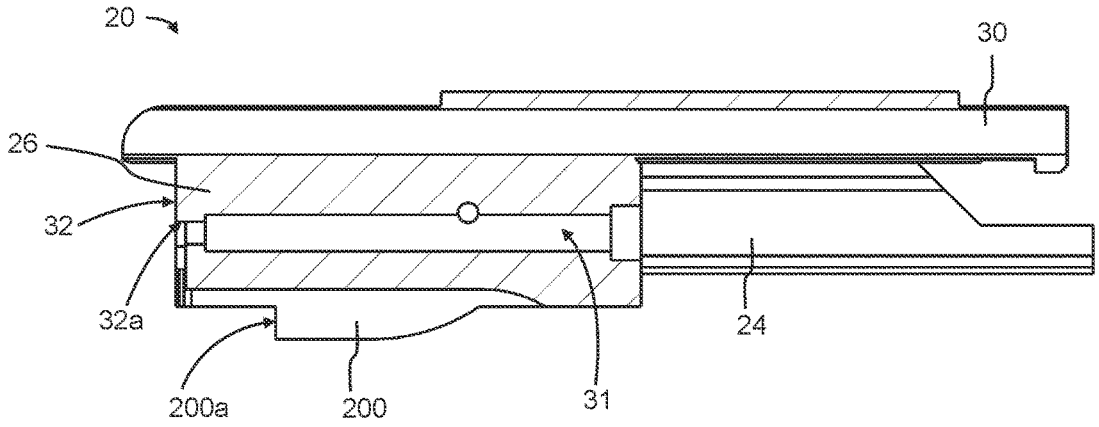
FIG. 6 shows a lateral cross-sectional view of the bolt carrier of FIG. 5.
Figure 7:
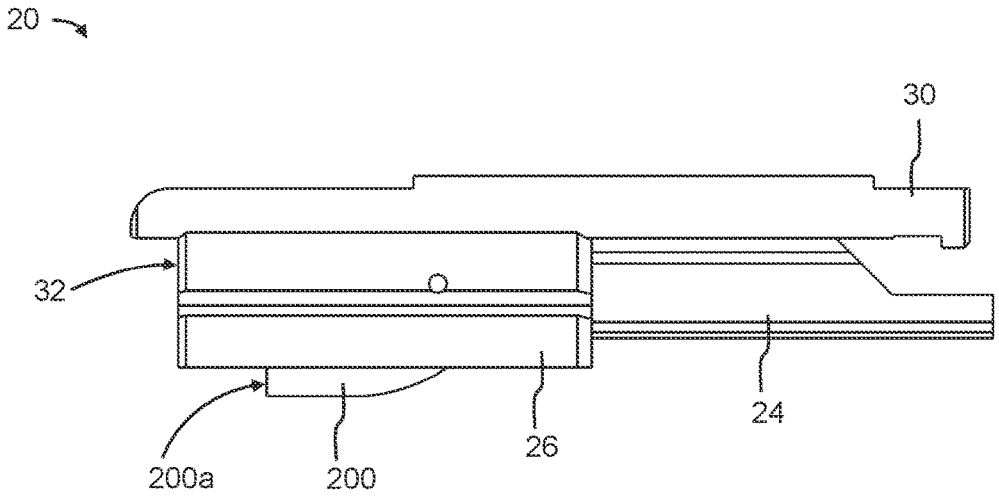
FIG. 7 shows a side plan view of the bolt carrier of FIG. 5.
Figure 8:
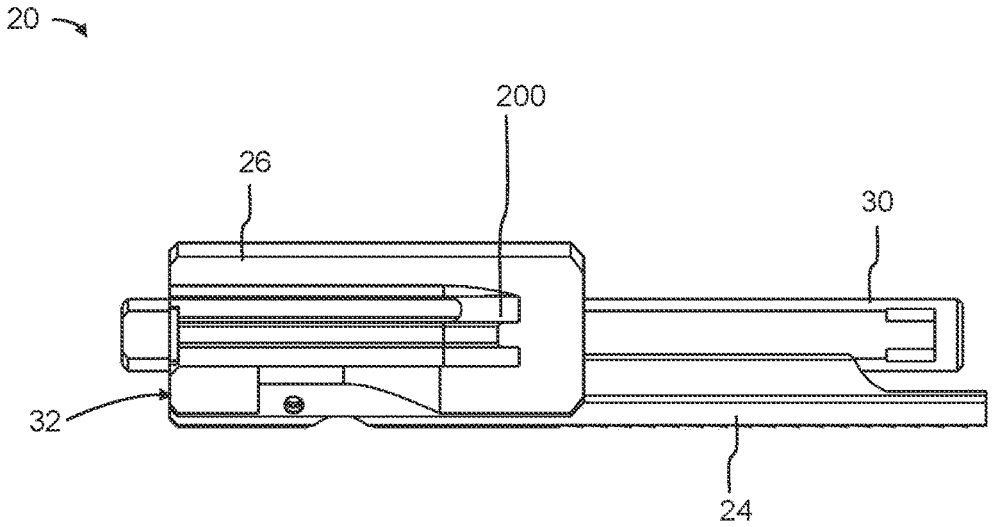
FIG. 8 shows a bottom plan view of the bolt carrier of FIG. 5.
Figure 9:
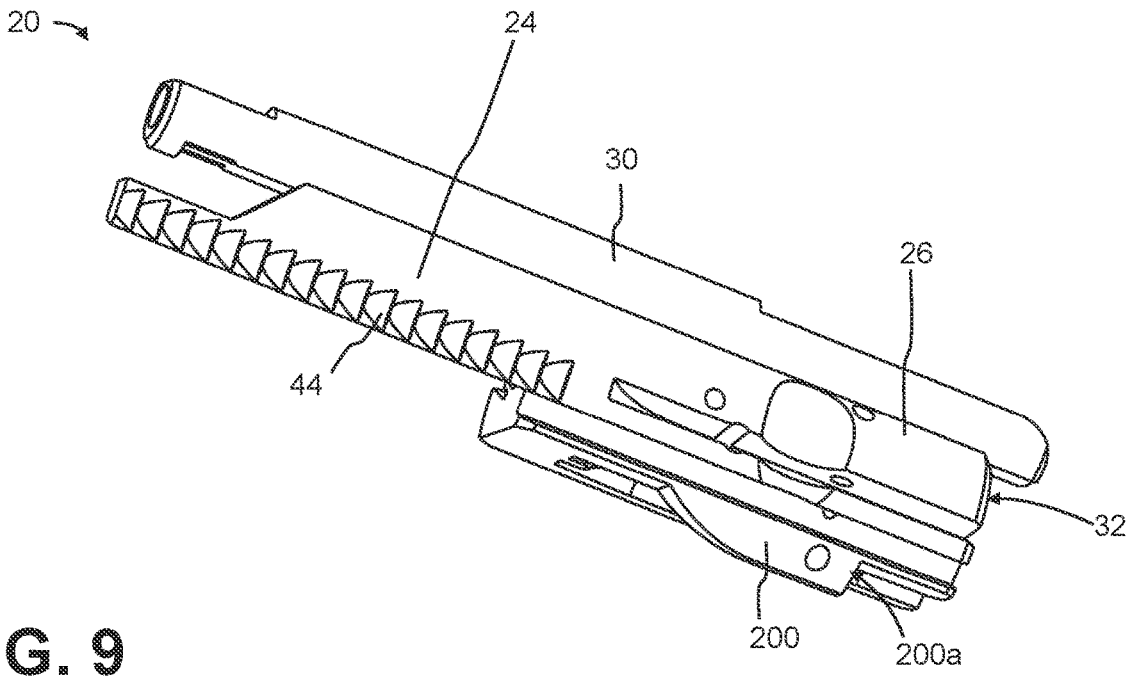
FIG. 9 shows a perspective view of the bolt carrier of FIG. 5.
Figure 10:
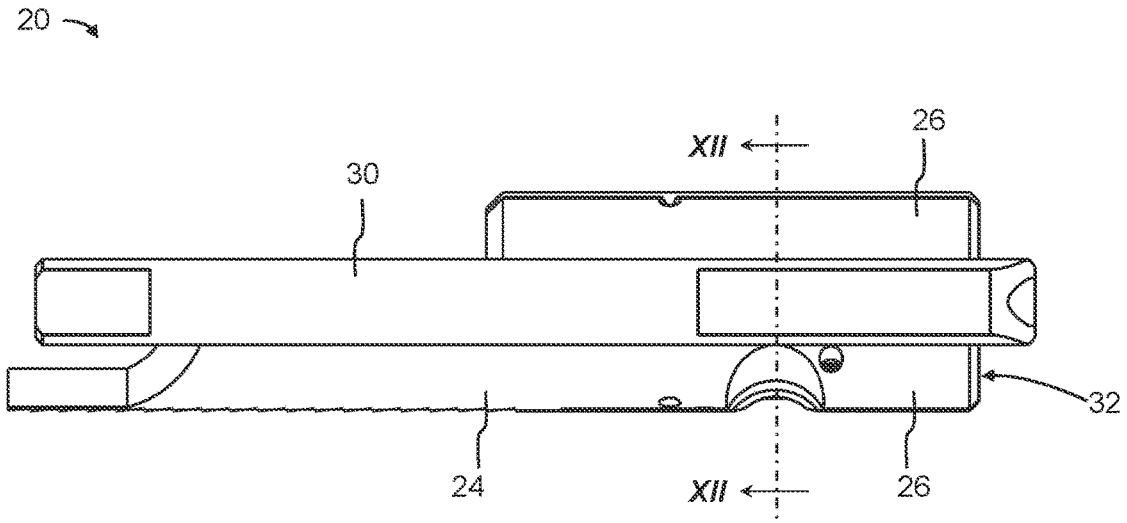
FIG. 10 shows a top plan view of the bolt carrier of FIG. 5.
Figure 11:
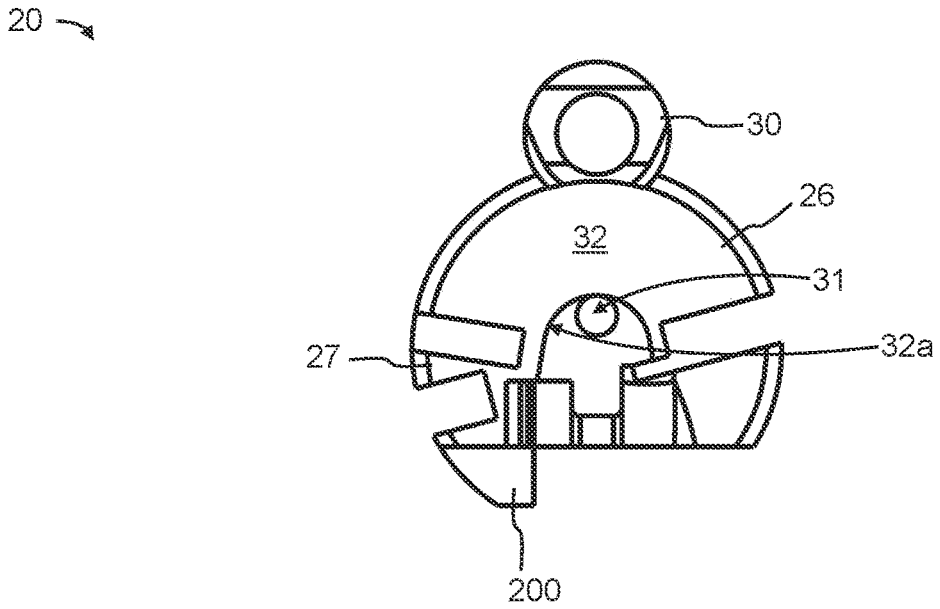
FIG. 11 shows a distal end plan view of the bolt carrier of FIG. 5.
Figure 12:
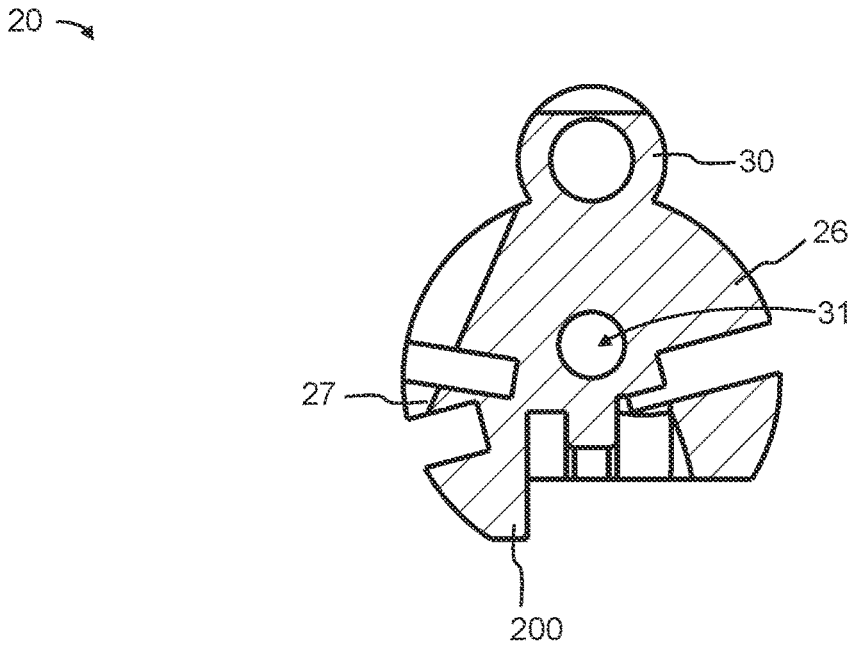
FIG. 12 shows a medial cross-sectional view of the bolt carrier of FIG. 5.

As shown in FIG. 4E, the spring tang 152 is configured to mate with the spring.

The body portion 153 may, in some embodiments, include a distal guide piston 153*a* disposed on the distal end of the body portion 153. When present, the distal guide piston 153*a* has a size and shape complementary to the distal guide channel 150 such that the distal guide piston 153*a* may slide along the distal guide channel 150.

In some embodiments, the body portion 153 further includes a bolt catch piston 153*b* disposed on the proximal end of the body portion 153 and having a size and shape complementary to the proximal guide channel 130 such that the bolt catch piston 153*b* may slide along the proximal guide channel 130. The bolt catch piston 153*b* is further configured to force upwards the bolt catch of the upper receiver after a final ammunition round is fed from the ammunition reservoir 140 to the upper receiver.

In some embodiments, the body portion 15 further includes a recess 154 disposed in a side wall. In such embodiments, the recess 154 may be positioned in the side wall such that the recess 154 aligns with the channel 160 of the magazine 10. The recess 154 is configured to receive a tool (not shown) through the channel 160. When engaged with the recess 154 through the channel 160, the tool enables a user to force the follower 15 up or down within the magazine 10 without removing the magazine 10 from a firearm receiver, for example to dislodge jammed ammunition cartridges within the magazine 10.

Referring now to FIGS. 5-12, bolt carriers 20 consistent with the present disclosure generally comprise a bolt carrier body 26, a sleeve 30 disposed on the superior portion of the carrier body 26, and a hold-open fin 200 disposed on the inferior portion of the bolt carrier 20.

The bolt carrier body 26 has a generally cylindrical cross-sectional shape and is configured to mate with the bolt (not shown). The bolt carrier body 26 includes a side-disposed ejector 27 configured to eject the casing of a spent ammunition round from the upper receiver. The bolt carrier body 26 further includes a forward assist adaptor 24 disposed at its proximal end. The forward assist adaptor 24 includes a plurality of side-disposed ridges 44 configured to engage with a forward assist assembly (not shown).

The bolt carrier body 26 includes a centerfire bore 31 disposed longitudinally through the bolt carrier body 26, and configured to enable a firing pin (not shown) to slide therethrough upon activation of a trigger mechanism of the firearm (not shown).

The bolt carrier body 26 further includes a rimfire alignment shoulder 32 disposed on its distal end. The rimfire alignment shoulder 32 defines a rimfire alignment contour 32*a* that engages the rim (e.g., the rim primer) of an ammunition round that has been fed from the magazine 10 to the upper receiver to align the rim of the ammunition round with the centerfire bore 31 such that the firing pin strikes the rim of the ammunition round instead of the central portion of the ammunition round, as would be the case if a 0.223 or 5.56 ammunition round were fed into a standard AR 15 or M16 bolt carrier body.

The bolt carrier 20 further includes a hold-open fin 200 disposed on its inferior portion. The hold-open fin 200 includes an engagement face 200*a* on its distal end. The engagement face 200*a* is configured to engage with the follower protrusion 151 (e.g., the apex 151*a*) of the follower 15 after the last ammunition round has been fed from the magazine reservoir 140 into the upper receiver and activated by the firing pin.

In some embodiments, the present disclosure provides an ammunition magazine 10 configured to bottom-feed a plurality of ammunition rounds into an upper receiver of a firearm, the ammunition magazine 10 comprising: a magazine housing 101 including an ammunition reservoir 140, a proximal guide channel 130 disposed proximal to the an ammunition reservoir 140, and lips 104 disposed on a top surface of the magazine housing 101, the lips 104 configured to align the ammunition reservoir 140 with a feed ramp of the upper receiver; a spring within the magazine housing 101; a floor plate retainer disposed at a bottom end of the spring; a floor plate disposed at a bottom end of the magazine housing 101 and reversibly mated with the floor plate retainer; and a magazine follower 15 disposed at a top end of the spring, the magazine follower 15 including a follower protrusion 151 disposed on a superior portion of the magazine follower 15, and a bolt catch piston 153*b* disposed at a proximal end of a body portion 153 of the magazine follower 15 and configured to slide along the proximal guide channel 130 of the magazine housing 101. In some embodiments, the magazine 10 further includes a distal guide channel 150 disposed distal to the ammunition reservoir 140, and wherein the magazine follower 15 further includes a distal guide piston 153*a* disposed at a distal end of the body portion 153 and configured to slide along the distal guide channel 150. In some embodiments, the ammunition magazine 10 further comprises a cham lel 160 disposed through the magazine housing 101, and wherein the follower 15 further includes a loading tab configured to slide along the channel 160. In some embodiments, the ammunition round is a 22LR round. In some embodiments, the magazine follower 15 further includes a spring tang disposed on an inferior portion of the magazine follower 15, wherein the spring tang is configured to engage with the top end of the spring. In some embodiments, the bolt catch piston 153*b* has a generally rounded rectangular or squircle cross-sectional shape. In some embodiments, the distal guide piston 153*a* has a cylindrical or truncated cylindrical rounded cross-sectional shape. In some embodiments, the bolt catch piston 153*b* is configured to engage a bolt catch of a lower receiver of a firearm after a final ammunition round is fed from the ammunition reservoir 140 into the upper receiver.

In some embodiments, the present disclosure provides a bolt carrier 20 for aligning a rimfire primer of an ammunition round with a centerfire firing pin of a firearm, the bolt carrier 20 comprising: a bolt carrier body 26 having a generally cylindrical cross-sectional shape and including a side-disposed extractor 27 disposed on one side of the bolt carrier body 26, a centerfire bore 31 disposed through the bolt carrier body 26 and configured to enable a centerfire firing pin to slide therethrough, a forward assist adaptor 24 disposed at a proximal end of the bolt carrier body 26 and including a plurality of side-disposed ridges 44 configured to temporarily engage with a forward assist piston of an upper receiver, a hold-open fin 200 disposed on an inferior portion of the bolt carrier body 26 and configured to engage with a bolt catch of a lower receiver of a firearm after a final ammunition round from the ammunition magazine 10 is struck by the centerfire firing pin, and a rimfire alignment shoulder 32*a* disposed on a distal end of the bolt carrier body 26 and configured to align the centerfire bore 31 with a rim of an ammunition round from the ammunition magazine 10; and a sleeve 30 disposed on a superior portion of the bolt carrier body 26 and configured to enable the bolt carrier 20 to slide along a rod (not shown). In some embodiments, the rimfire alignment shoulder 32*a* includes an arcuate rimfire alignment contour configured to engage the rim of the ammunition round.

In some embodiments, the present disclosure provides a kit comprising an ammunition magazine 10 as disclosed herein, and a bolt carrier 20 as disclosed herein. In some embodiments, the ammunition reservoir 140 is configured to retain 20 ammunition rounds. In some embodiments, the ammunition rounds are 22LR rounds.

EXAMPLES

Example 1

A magazine with follower consistent with the magazines and followers of FIGS. 1-4B was constructed using PLA filament and a commercially available 3D printer. The follower was placed into the ammunition reservoir and a compression spring was disposed between the spring tang and the bottom inside surface of the ammunition reservoir.

22LR ammunition cartridges were then top-loaded one-by-one into the ammunition reservoir through the lips until the ammunition reservoir was filled to capacity in a single stack configuration.

The magazine was mated with a receiver of an AR15 style rifle including a bolt consistent with the hold-open bolt of FIGS. 5-12. The LR22 ammunition cartridges were fired one-by-one through the rifle. When the LR22 ammunition cartridges were properly loaded into the magazine reservoir (i.e., with the rim of each LR22 ammunition cartridge disposed distal to the rim of the LR22 ammunition cartridge immediately below), no misfires or jams were observed when the receiver, and the LR22 cartridges did not jam within the ammunition reservoir.

Example 2

A magazine with follower consistent with the magazines and followers of FIGS. 1-4B was constructed using PLA filament and a commercially available 3D printer. The follower was placed into the ammunition reservoir and a compression spring was disposed between the spring tang and the bottom inside surface of the ammunition reservoir.

The empty magazine was mated with a receiver of an AR15 style rifle including a bolt consistent with the hold-open bolt of FIGS. 5-12. The charging handle was racked and then the bolt release was pressed to enable the bolt to slide forward towards the lips of the magazine, through which the follower was exposed to the bolt. The follower successfully held the bolt open during repeated tests.

Further Examples

Further Example 1. An ammunition magazine configured to bottom-feed a plurality of ammunition rounds into an upper receiver of a firearm, the ammunition magazine comprising:

a magazine housing including:

an ammunition reservoir, a proximal guide channel disposed proximal to the ammunition reservoir, and lips disposed on a top surface of the magazine housing, the lips configured to align the ammunition reservoir with a feed ramp of the upper receiver;

a spring within the magazine housing;

a floor plate retainer disposed at a bottom end of the spring;

a floor plate disposed at a bottom end of the magazine housing and reversibly mated with the floor plate retainer; and a magazine follower disposed at a top end of the spring, the magazine follower including:

a follower protrusion disposed on a superior portion of the magazine follower, and a bolt catch piston disposed at a proximal end of a body portion of the magazine follower and configured to slide along the proximal guide channel of the magazine housing.

Further Example 2. The ammunition magazine of Further Example 1, wherein the magazine further includes a distal guide channel disposed distal to the ammunition reservoir, and wherein the magazine follower further includes a distal guide piston disposed at a distal end of the body portion of the magazine follower and configured to slide along the distal guide channel.

Further Example 3. The ammunition magazine of Further Example 1 or Further Example 2 further comprising a tab channel disposed through the magazine housing, and wherein the follower further includes a loading tab configured to slide along the tab channel.

Further Example 4. The ammunition magazine of any one preceding Further Example, wherein the ammunition round is a 22LR round.

Further Example 5. The ammunition magazine of any one preceding Further Example, wherein the magazine follower further includes a spring tang disposed on an inferior portion of the magazine follower, wherein the spring tang is configured to engage with the top end of the spring.

Further Example 6. The ammunition magazine of any one preceding Further Example, wherein the bolt catch piston has a generally rounded rectangular or squircle cross-sectional shape.

Further Example 7. The ammunition magazine of any one of Further Example 2-6, wherein the distal guide piston has a cylindrical or truncated cylindrical cross-sectional shape.

Further Example 8. The ammunition magazine of any one preceding Further Example, wherein the bolt catch piston is configured to engage a bolt catch of a lower receiver of a firearm after a final ammunition round is fed from the ammunition reservoir 140 into the upper receiver.

Further Example 9. A bolt carrier for aligning a rimfire primer of an ammunition round with a centerfire firing pin of a firearm, the bolt carrier comprising:

a bolt carrier body having a generally cylindrical cross-sectional shape and including:

a side-disposed extractor disposed on one side of the bolt carrier body, a centerfire bore disposed through the bolt carrier body and configured to enable a centerfire firing pin to slide therethrough, a forward assist adaptor disposed at a proximal end of the bolt carrier body and including a plurality of side-disposed ridges configured to temporarily engage with a forward assist piston of an upper receiver, a hold-open fin disposed on an inferior portion of the bolt carrier body and configured to engage with a bolt catch of a lower receiver of a firearm after a final ammunition round from the ammunition magazine is struck by the centerfire firing pin, and a rimfire alignment shoulder disposed on a distal end of the bolt carrier body and configured to align the centerfire bore with a rim of an ammunition round from the ammunition magazine; and a sleeve disposed on a superior portion of the bolt carrier body and configured to enable the bolt carrier to slide along a rod.

Further Example 10. The bolt carrier of Further Example 9, wherein the rimfire alignment shoulder includes an arcuate rimfire alignment contour configured to engage the rim of the ammunition round.

Further Example 11. A kit comprising:

an ammunition magazine of any one of Further Examples 1-8; and a bolt carrier of Further Example 9 or Further Example 10.

Further Example 12. The kit of Further Example 11, wherein the ammunition magazine includes an ammunition reservoir configured to retain 20 ammunition rounds.

Further Example 13. The kit of Further Example 12, wherein the ammunition rounds are 22LR rounds.

What is claimed is:

1. An ammunition magazine configured to bottom-feed a plurality of ammunition rounds into an upper receiver of a firearm, the ammunition magazine comprising:

a magazine housing including:

an ammunition reservoir, a proximal guide channel disposed proximal to the ammunition reservoir, a storage compartment disposed distal to the ammunition reservoir and accessible through an opening in a top surface of the magazine housing; and lips disposed on the top surface of the magazine housing, the lips configured to align the ammunition reservoir with a feed ramp of the upper receiver;

spring within the magazine housing;

a floor plate retainer disposed at a bottom end of the spring;

a floor plate disposed at a bottom end of the magazine housing and reversibly mated with the floor plate retainer; and a magazine follower disposed at a top end of the magazine housing, the magazine follower including:

a follower protrusion disposed on a superior portion of the magazine follower, and a bolt catch piston disposed at a proximal end of a body portion of the magazine follower and configured to slide along the proximal guide channel of the magazine housing, wherein a region of the body portion defines a recess adapted to removably receive a tool.

2. The ammunition magazine of claim 1, wherein the magazine further includes a distal guide channel disposed distal to the ammunition reservoir, and wherein the magazine follower further includes a distal guide piston disposed at a distal end of the body portion of the magazine follower and configured to slide along the distal guide channel.

3. The ammunition magazine of claim 2, wherein the distal guide piston has a cylindrical or truncated cylindrical cross-sectional shape.

4. The ammunition magazine of claim 1 further comprising a tab channel disposed through the magazine housing, and wherein the follower further includes a loading tab configured to slide along the tab channel.

5. The ammunition magazine of claim 1, wherein the ammunition round is a 22LR round.

6. The ammunition magazine of claim 1, wherein the magazine follower further includes a spring tang disposed on an inferior portion of the magazine follower, wherein the spring tang is configured to engage with the top end of the spring.

7. The ammunition magazine of claim 1, wherein the bolt catch piston has a generally rounded rectangular or squircle cross-sectional shape.

8. The ammunition magazine of claim 1, wherein the bolt catch piston is configured to engage a bolt catch of a lower receiver of a firearm after a final ammunition round is fed from the ammunition reservoir into the upper receiver.

9. The magazine as recited in claim 1 wherein the storage compartment is disposed distal to the distal guide channel.

10. The magazine as recited in claim 1 wherein the storage compartment is adapted to house a tool or accessory.

11. The magazine as recited in claim 1 wherein a recess is disposed in a wall of the body portion such that the recess aligns with a channel formed in a side face or an end face of the magazine.

12. The magazine as recited in claim 11 wherein the recess is configured to removably receive the tool through the channel.

13. The magazine as recited in claim 12 wherein the tool so received allows a user to force the follower up or down within the magazine without removing the magazine from the upper receiver.

* * * * *